US007449631B2

(12) United States Patent
Lee et al.

(10) Patent No.: US 7,449,631 B2
(45) Date of Patent: Nov. 11, 2008

(54) COAXIAL CABLE

(75) Inventors: Hsi-Fu Lee, Taipei Hsien (TW); Liang Liu, Beijing (CN); Kai-Li Jiang, Beijing (CN); Caesar Chen, Santa Clara, CA (US); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/860,501

(22) Filed: Sep. 24, 2007

(65) Prior Publication Data

US 2008/0251270 A1 Oct. 16, 2008

(30) Foreign Application Priority Data

Apr. 11, 2007 (CN) ..... 2007 1 0073893

(51) Int. Cl.
*H01B 7/00* (2006.01)

(52) U.S. Cl. ..... 174/28; 174/102 R; 174/108

(58) Field of Classification Search ..... 174/28, 174/102 R, 106 R, 108, 102 SC, 106 SC
See application file for complete search history.

(56) References Cited

U.S. PATENT DOCUMENTS

| | | | | |
|---|---|---|---|---|
| 7,045,716 | B2 * | 5/2006 | Granheim | 174/102 SC |
| 2004/0020681 | A1 * | 2/2004 | Hjortstam et al. | 174/102 SC |
| 2005/0170177 | A1 * | 8/2005 | Crawford et al. | 428/375 |

* cited by examiner

*Primary Examiner*—William H Mayo, III
(74) *Attorney, Agent, or Firm*—D. Austin Bonderer

(57) ABSTRACT

A coaxial cable (10) includes at least one conducting wire (110), at least one insulating layer (120) coating a respective conducting wire (110), at least one shielding layer (130) surrounding the at least one insulating layer (120), and a single sheath (140) wrapping the at least one shielding layer (130). The shielding layer (130) includes a number of carbon nanotube yarns.

20 Claims, 4 Drawing Sheets

COAXIAL CABLE

RELATED APPLICATIONS

This application is related to commonly-assigned, co-pending applications. The applications are as follows: U.S. patent application Ser. No. 11/564,266, entitled, "COAXIAL CABLE", filed Nov. 28, 2006; U.S. patent application Ser. No. 11/860,503, entitled "COAXIAL CABLE", filed Sep. 24, 2007 and U.S. patent application Ser. No. 11/860,504, entitled "COAXIAL CABLE", filed Sep. 24, 2007. The disclosures of the above-identified applications are respectively incorporated herein by reference.

BACKGROUND

1. Field of the Invention

The present invention relates to cables and, particularly, to a coaxial cable.

2. Discussion of Related Art

A coaxial cable is an electrical cable including an inner conductor, an insulating layer, and a conducting layer, usually surrounded by a sheath. The inner conductor can be, e.g., a solid or braided wire, and the conducting layer can, for example, be a wound foil, a woven tape, or a braid. The coaxial cable requires an internal insulating layer (i.e., a dielectric) to act as a physical support and to maintain a constant spacing between the inner conductor and the conducting layer, in addition to electrically isolating the two.

The coaxial cable may be rigid or flexible. Typically, the rigid type has a solid inner conductor, while the flexible type has a braided inner conductor. The conductors for both types are usually made of thin copper wires. The insulating layer, also called the dielectric, has a significant effect on the properties of the cable, such as its characteristic impedance and its attenuation. The dielectric may be solid or perforated with air spaces. The shielding layer is configured for ensuring that a signal to be transmitted stays inside the cable and that all other signals to stay out (i.e., acts as a two-way signal shield). The shielding layer also serves as a secondary conductor or ground wire.

The coaxial cable is generally applied as a high-frequency transmission line to carry a high frequency or broadband signal. Sometimes, DC power (called a bias) is added to the signal to supply the equipment at the other end, as in direct broadcast satellite receivers, with operating power. The electromagnetic field carrying the signal exists (ideally) only in the space between the inner conductor and conducting layer, so the coaxial cable cannot interfere with and/or suffer interference from external electromagnetic fields.

However, the conventional coaxial cable is low in yield and high in cost. Therefore, a coaxial cable that has great shield effectiveness and that is suitable for low-cost mass production is desired.

SUMMARY OF THE INVENTION

Accordingly, a coaxial cable that has great shield effectiveness and is suitable for low-coat mass production is provided in the present cable. The coaxial cable includes at least one conducting wire; at least one insulating layer, each insulating layer being respectively coated on a corresponding conducting wire; at least one shielding layer surrounding the insulating layer; and a sheath. The shielding layer includes a plurality of carbon nanotube yarns.

In one present embodiment, a coaxial cable is provided that includes a conducting wire, an insulating layer applied on the conducting wire, a shielding layer deposited on the insulating layer, and a sheath coating the shielding layer.

In another present embodiment, a coaxial cable is provided that includes a number of conducting wires, a number of insulating layers respectively applied on the corresponding conducting wires, a shielding layer surrounding all the conducting wires coated with a corresponding insulating layer, and a sheath coating the shielding layer.

In another present embodiment, a coaxial cable is provided that includes a number of conducting wires, a number of insulating layers respectively supplied on the corresponding conducting wires, a number of shielding layers respectively coating the corresponding insulating layers, and a sheath, in turn, surrounding all the conducting wires, each coated with a corresponding combination of an insulating layer and a shielding layer.

BRIEF DESCRIPTION OF THE DRAWINGS

Many aspects of the present coaxial cable can be better understood with reference to the following drawings. The components in the drawings are not necessarily to scale, the emphasis instead being placed upon clearly illustrating the present coaxial cable.

DETAILED DESCRIPTION OF PREFERRED EMBODIMENTS

The present coaxial cable is further described below with reference to the drawings.

The present coaxial cable includes at least one conducting wire, at least one insulating layer, each insulating layer respectively surrounding a corresponding conducting wire, at least one shielding layer encompassing the at least one insulating layer, and a sheath wrapping the above-mentioned three parts thereof. The coaxial cable is, usefully, an electromagnetic interference (EMI) shield cable.

Figure 1:
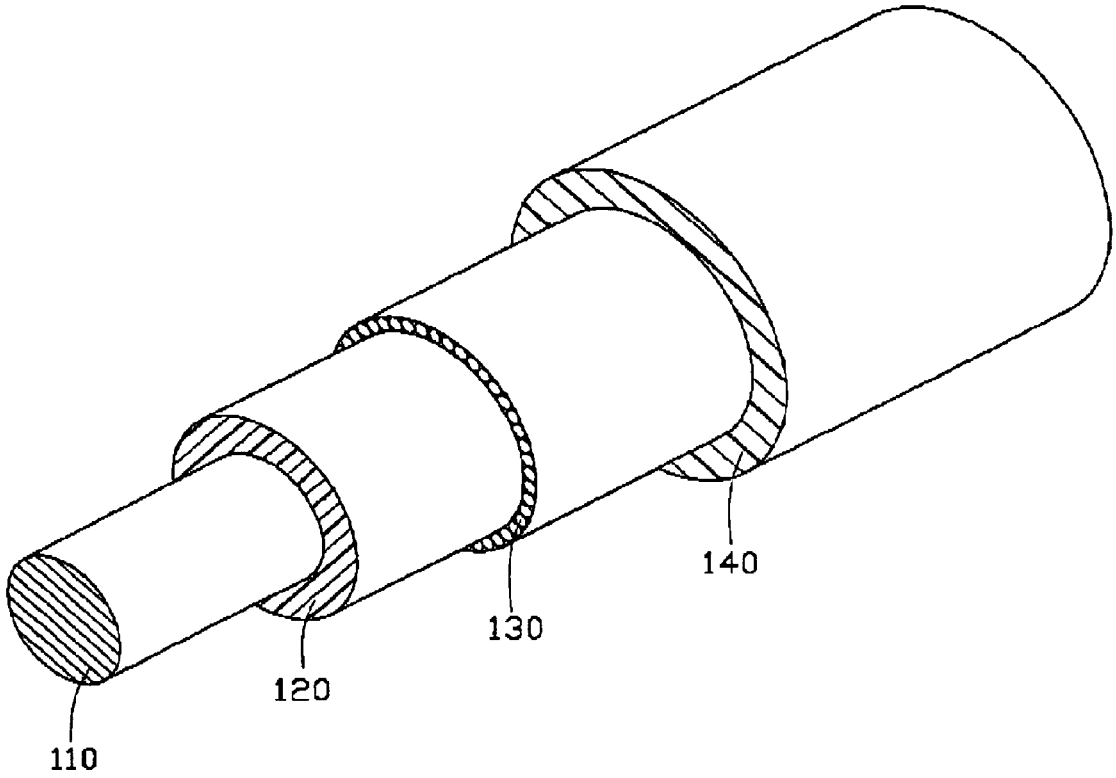
FIG. 1 is a perspective view of a coaxial cable of the first embodiment.
Figure 2:
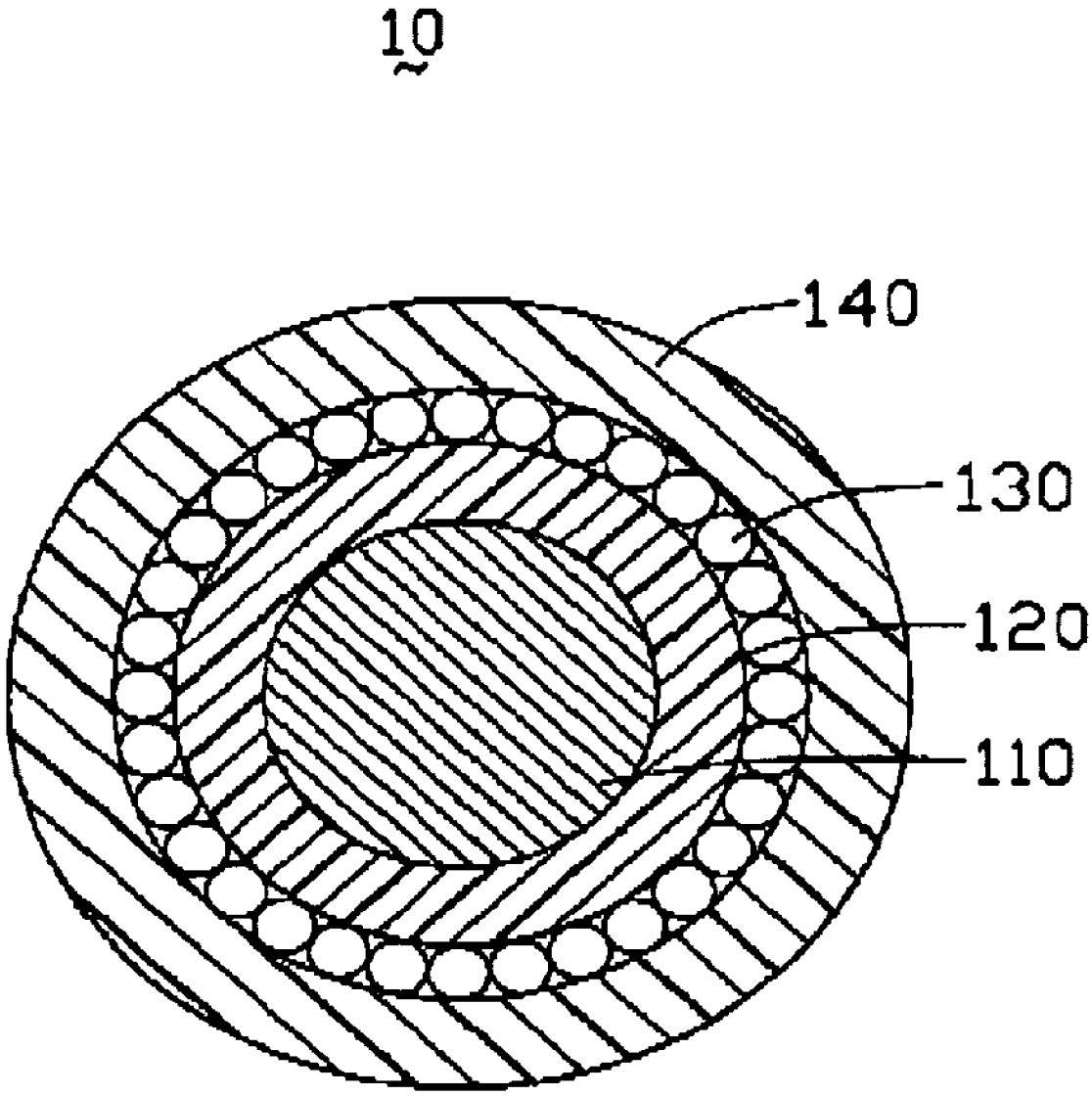
FIG. 2 is a plane, cross-sectional view along the II-II direction of the coaxial cable in FIG. 1.

Referring to FIGS. 1 and 2, a coaxial cable 10, according to the first embodiment, is shown. The coaxial cable 10 includes a conducting wire 110, an insulating layer 120, a shielding layer 130 and a sheath 140. The axis of the conducting wire 110, the insulating layer 120, the shielding layer 130, and the sheath 140 is consistent (i.e., such elements are coaxial), and the arrangement thereof is, in turn, from center/inner to outer.

The conducting wire 110 can be a single wire or a number of stranded wires. The conducting wire 110 is made of a conducting material, such as a metal, an alloy, a carbon nanotube, or a carbon nanotube composite having electrical conduction. Advantageous metals for this purpose are aluminum (Al) or copper (Cu). A particularly useful alloy is a copper-zinc alloy or a copper-silver alloy, wherein a mass percent of copper in the copper-zinc alloy is about 70% and that in the copper-silver alloy is about 10-40%. The carbon nanotube composite advantageously includes the carbon nanotubes and one of the above-mentioned alloys. Beneficially, the mass percent of the carbon nanotubes in the carbon nanotube composite is 0.2%-10%. The carbon nanotube is, usefully, a sort of carbon nanotube chain connected by van der Waals attractive forces between ends of adjacent carbon nanotubes.

The insulating layer 120 coating/surrounding the conducting wire 110 is an electric insulator/dielectric, and can be, for example, polytetrafluoroethylene (PTFE) or a nano-sized clay/polymer composite. The clay of the composite is a hydrated aluminosilicate mineral in a nano-sized layer form. The mineral can, for example, be nano-sized kaolinite or nano-sized montmorillonite. The polymer of the clay/polymer composite is, usefully, chosen from the group consisting a material of silicone, polyamide, and polyolefin, such as polyethylene and polypropylene. In the appropriate embodiment, the clay/polymer composite includes nano-sized montmorillonite and polyethylene. The clay/polymer composite has many good properties such as electrically insulating, fire resistant, low smoke potential, and halogen-free. The clay/polymer is an environmentally friendly material and can be applied as an electrically insulating material to protect the conducting wire and keep/maintain a certain space between the conducting wire and the shielding layer.

Referring to FIG. 2, the shielding layer 130 includes a number of carbon nanotube yarns. The carbon nanotube yarns coating/encompassing the insulating layer 120 are in a bundle form or in a mesh form. The carbon nanotube yarn includes a number of carbon nanotubes that are joined end to end by van der Waals attractive force, and the carbon nanotubes in each carbon nanotube yarn are substantially parallel to each other..

A method for making carbon nanotube yarn includes the steps of: (1) providing a carbon nanotube array; and (2) drawing out a carbon nanotube yarn from the carbon nanotube array.

In the step (1), the carbon nanotube array is generally a super-aligned carbon nanotube array. The carbon nanotube array can be manufactured using a chemical vapor deposition method. The method includes the steps of: (a) providing a substantially flat and smooth substrate, with the substrate being, e.g., a p-type or n-type silicon wafer; (b) depositing a catalyst on the substrate, the catalyst being usefully selected from the group consisting of iron, cobalt, nickel or alloys of the same; (c) annealing the substrate with the catalyst in protective gas at 300~400° C. for about 10 hours; and (d) heating the annealed substrate with the catalyst to 500~700° C., supplying a mixture of carbon-containing gas and protective gas, controlling a difference between the local temperature of the catalyst and the environmental temperature to be at least 50° C., controlling a partial pressure of the carbon-containing gas to be less than 0.2, and growing a number of carbon nanotubes on the substrate after 5~30 minutes such that the carbon nanotube array is formed on the substrate. The carbon-containing gas can be a hydrocarbon such as acetylene, ethane, etc. The protective gas can be an inert gas or nitrogen gas.

The superficial density of the carbon nanotube array manufactured by above-described process with carbon nanotube being compactly bundled together is higher. The van der Waals attractive force between adjacent carbon nanotubes is strong, and diameters of the carbon nanotubes are correspondingly substantial.

In the step (2), the carbon nanotube yarn may be drawn out from the carbon nanotube array with a tool with a sharp tip, such as a tweezers. Specifically, an initial carbon nanotube of the carbon nanotube array can be drawn out with tweezers. As a carbon nanotube is drawn out, other carbon nanotubes are also drawn out due to the van der Waals attractive force between ends of adjacent carbon nanotubes, and a successive carbon nanotube yarn is formed. The carbon nanotube yarn may, for example, have a length of several centimeters and a thickness of several microns.

The material of the sheath 140 is, advantageously, the same as the material used for the insulating layer 120. This kind of material has many good properties, such as good mechanical behavior, electrically insulating, fire resistant, chemically durable, low smoke potential, and halogen-free. Thus, the material is an environmentally friendly material and can be applied to protect the coaxial cable 10 from external injury, such as physical, chemical, and/or mechanical injury.

Figure 3:
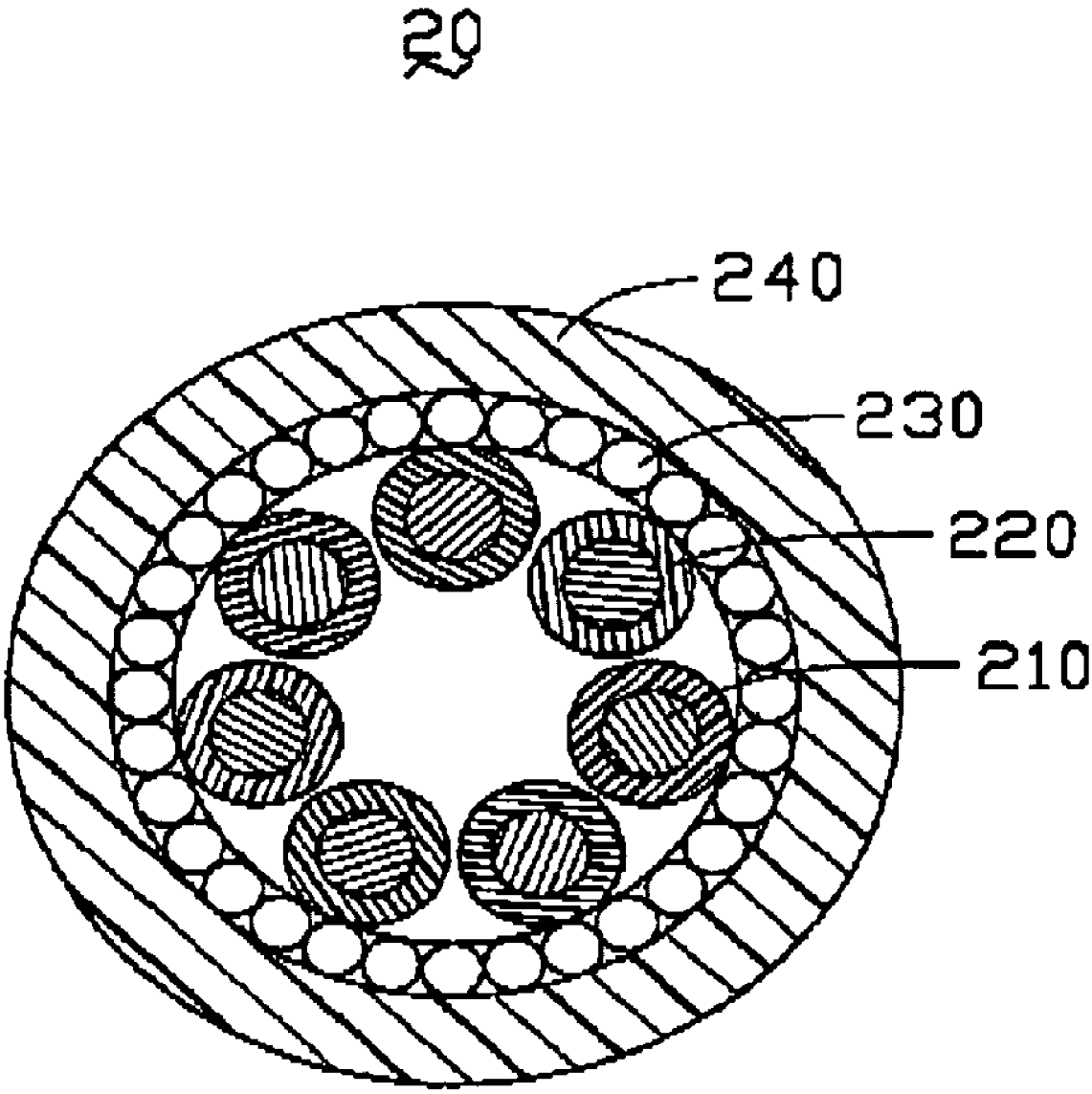
FIG. 3 is a plane, cross-sectional view of a coaxial cable of the second embodiment.

Referring to FIG. 3, a coaxial cable 20, according to the second embodiment, is shown. The coaxial cable 20 includes a number of conducting wires 210; a number of insulating layers 220 each, respectively, surrounding a corresponding one of the conducting wires 210; a single shielding layer 230 surrounding all the conducting wires 210 with the corresponding insulating layer 220 coated thereon; and a single sheath 240 wrapping the shielding layer 230. The materials of the conducting wires 210, the insulating layer 220, the shielding layer 230, and the sheath 240 are substantially similar to the materials of the corresponding parts in the first embodiment.

Figure 4:
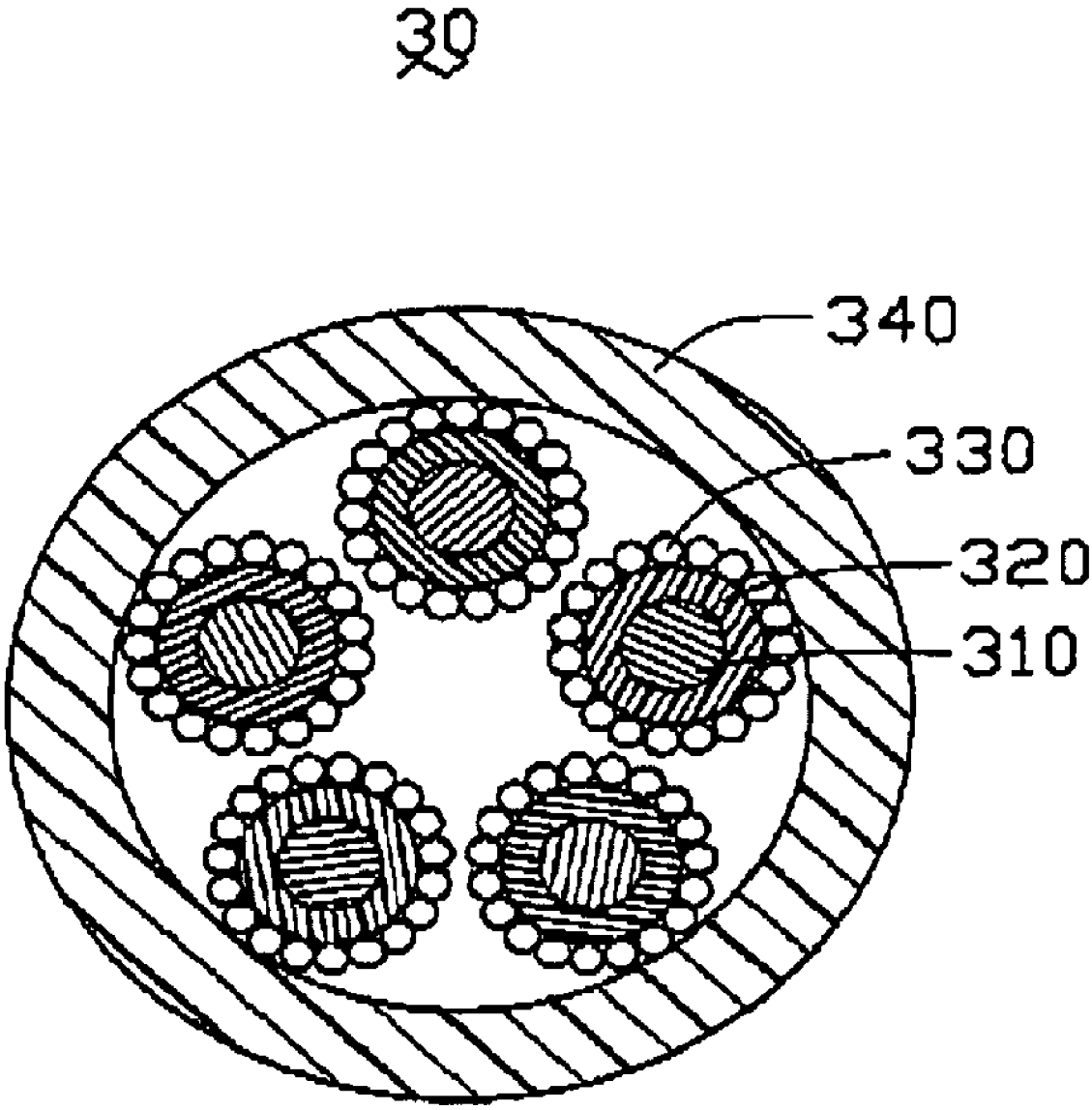
FIG. 4 is a plane, cross-sectional view of a coaxial cable of the third embodiment.

Referring to FIG. 4, a coaxial cable 30, according to the third embodiment, is shown. The coaxial cable 30 includes a number of conducting wires 310; a number of insulating layers 320 respectively coating a corresponding one of the conducting wires 310; a number of shielding layers 330 respectively applied to a corresponding one the insulating layers 320; and a single sheath 340 wrapping all the conducting wires 310. Each conducting wire 310 is coated with a corresponding insulating layer 320 and a corresponding shielding layer 330. The materials of the conducting wires 310, the insulating layers 320, the shielding layers 330, and the sheath 340 are substantially similar to the materials of the corresponding parts in the first embodiment. The arrangement of the respective shielding layers 330 each surrounding a corresponding one of the conducting wires 310 can provide quite good shielding against noises (i.e., electrical interference) from outside and between the conducting wires 310. This arrangement ensures the stable characteristics of the coaxial cable 30.

Finally, it is to be understood that the embodiments mentioned above are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A coaxial cable comprising:

at least one conducting wire;

at least one insulating layer, each insulating layer is located about a corresponding conducting wire;

at least one shielding layer surrounding the at least one insulating layer, each shielding layer comprising a plurality of carbon nanotube yarns; and a sheath wrapping the at least one shielding layer.

2. The coaxial cable as claimed in claim 1, wherein the coaxial cable comprises a conducting wire, an insulating layer applied directly upon the conducting wire, a shielding layer located adjacent to the insulating layer, and a sheath wrapping the shielding layer.

3. The coaxial cable as claimed in claim 1, wherein the coaxial cable comprises a plurality of conducting wires, a plurality of insulating layers each respectively coated on a corresponding one of the conducting wires, a shielding layer surrounding all the coated conducting wires, and a sheath wrapping the shielding layer.

4. The coaxial cable as claimed in claim 1, wherein the coaxial cable comprises a plurality of conducting wires, a plurality of insulating layers respectively coated on a corresponding one of the conducting wires, a plurality of shielding layers respectively coated on a corresponding one of the insulating layers, and a sheath wrapping all the conducting wires being coated by the insulating layers and the shielding layers, in turn, with the corresponding insulating layer and the corresponding shielding layer.

5. The coaxial cable as claimed in claim 1, wherein the carbon nanotube yarns are directly wrapped in a bundle form so as to surround the insulating layer.

6. The coaxial cable as claimed in claim 1, wherein the carbon nanotube yarns are woven in a mesh form and surround the insulating layer.

7. The coaxial cable as claimed in claim 6, wherein the carbon nanotubes in each carbon nanotube yarn are substantially parallel to each other.

8. The coaxial cable as claimed in claim 1, wherein each of the carbon nanotube yarns includes a number of carbon nanotubes, and the carbon nanotubes are joined end to end by van der Waals attractive force.

9. The coaxial cable as claimed in claim 1, wherein the carbon nanotube yarn has a length of several centimeters and a thickness of several microns.

10. The coaxial cable as claimed in claim 1, wherein the conducting wire is comprised of a metal, an alloy, a carbon nanotube, or a carbon nanotube composite.

11. The coaxial cable as claimed in claim 1, wherein the shielding layers comprise of at least fifty percent carbon nanotubes.

12. The coaxial cable as claimed in claim 1, wherein the shielding layers comprise of at least seventy-five percent carbon nanotubes.

13. The coaxial cable as claimed in claim 1, wherein the shielding layers comprise of at least fifty percent carbon nanotubes.

14. The coaxial cable as claimed in claim 1, wherein the shielding layers comprise of at least seventy-five percent carbon nanotubes.

15. A coaxial cable comprising;

N conducting wires;

N insulating layers; and

M shielding layers;

wherein each conducting wire is insulated by one of the N insulating layers; the shielding layers comprise of plurality of nanotube yarns; N is a positive integer greater than zero; and M is a positive integer greater than zero.

16. The coaxial cable as claimed in claim 15, wherein N is equal to one, and M is equal to one, and a shielding layer located adjacent to the insulating layer.

17. The coaxial cable as claimed in claim 15, wherein the carbon nanotube yarns are in a bundle form and surround the N insulating layers.

18. The coaxial cable as claimed in claim 15, wherein the carbon nanotube yarns are woven in a mesh form and surround the N insulating layers.

19. The coaxial cable as claimed in claim 15, wherein each carbon nanotube yarn has a length of several centimeters and a thickness of several microns.

20. The coaxial cable as claimed in claim 15, wherein the conducting wire is comprised of a metal, an alloy, a carbon nanotube, or a carbon nanotube composite.

* * * * *